US006418358B1

(12) United States Patent
Armanini et al.

(10) Patent No.: US 6,418,358 B1
(45) Date of Patent: Jul. 9, 2002

(54) ITEM HANDLING SYSTEM

(75) Inventors: Pietro Armanini, Herts; Raglan Tribe, Hants, both of (GB)

(73) Assignee: De La Rue International Limited, Hampshire (GB)

( * ) Notice: Subject to any disclaimer, the term of this patent is extended or adjusted under 35 U.S.C. 154(b) by 0 days.

(21) Appl. No.: 09/672,032

(22) Filed: Sep. 29, 2000

(30) Foreign Application Priority Data

Aug. 2, 2000 (GB) ..... 0018972

(51) Int. Cl.[7] ..... G06F 7/00
(52) U.S. Cl. ..... 700/225
(58) Field of Search ..... 700/213, 225, 700/226, 241, 2, 3; 270/52.02, 52.03; 209/534

(56) References Cited

U.S. PATENT DOCUMENTS

| | | | | |
|---|---|---|---|---|
| 4,114,804 | A | | 9/1978 | Jones et al. |
| 4,179,685 | A | | 12/1979 | O'Maley |
| 4,275,874 | A | | 6/1981 | DiBlasio |
| 4,386,432 | A | | 5/1983 | Nakamura et al. |
| 4,571,489 | A | | 2/1986 | Watanabe |
| 4,684,119 | A | | 8/1987 | Lane |
| 4,993,700 | A | | 2/1991 | Winkler |
| 5,163,672 | A | | 11/1992 | Mennie |
| 5,295,196 | A | | 3/1994 | Raterman et al. |
| 5,467,405 | A | | 11/1995 | Raterman et al. |
| 5,467,406 | A | | 11/1995 | Graves et al. |
| 5,619,416 | A | * | 4/1997 | Kosarew ..... 364/478.13 |
| 5,633,949 | A | | 5/1997 | Graves et al. |
| 5,640,463 | A | | 6/1997 | Csulits |
| 5,652,802 | A | | 7/1997 | Graves et al. |
| 5,687,963 | A | | 11/1997 | Mennie |
| 5,692,067 | A | | 11/1997 | Raterman et al. |
| 5,704,491 | A | | 1/1998 | Graves |
| 5,724,438 | A | | 3/1998 | Graves |
| 5,751,840 | A | | 5/1998 | Raterman et al. |
| 5,790,693 | A | | 8/1998 | Graves et al. |
| 5,790,697 | A | | 8/1998 | Munro et al. |
| 5,806,650 | A | | 9/1998 | Mennie et al. |
| 5,815,592 | A | | 9/1998 | Mennie et al. |
| 5,822,448 | A | | 10/1998 | Graves et al. |
| 5,832,104 | A | | 11/1998 | Graves et al. |
| 5,867,589 | A | | 2/1999 | Graves et al. |
| 5,870,487 | A | | 2/1999 | Graves et al. |
| 5,875,259 | A | | 2/1999 | Mennie et al. |
| 5,909,502 | A | | 6/1999 | Mazur |
| 5,909,503 | A | | 6/1999 | Graves et al. |
| 5,912,982 | A | | 6/1999 | Munro et al. |
| 5,938,044 | A | | 8/1999 | Weggesser |
| 5,960,103 | A | | 9/1999 | Graves et al. |
| 5,966,456 | A | | 10/1999 | Jones et al. |
| 5,982,918 | A | | 11/1999 | Mennie et al. |
| 5,992,601 | A | | 11/1999 | Mennie et al. |
| 6,012,565 | A | | 1/2000 | Mazur |
| 6,021,883 | A | | 2/2000 | Casanova et al. |
| 6,026,175 | A | * | 2/2000 | Munro et al. ..... 382/135 |
| 6,028,951 | A | | 2/2000 | Raterman et al. |
| 6,137,590 | A | * | 10/2000 | Mori ..... 358/1.17 |

FOREIGN PATENT DOCUMENTS

| | | |
|---|---|---|
| EP | 0 368 498 A2 | 5/1990 |
| WO | WO 99/62019 | 12/1999 |

* cited by examiner

*Primary Examiner*—Christopher P. Ellis
*Assistant Examiner*—Khoi H. Tran
(74) *Attorney, Agent, or Firm*—Oliff & Berridge PLC

(57) ABSTRACT

An item handling system comprises an item processing device having input and output stations, a transport system for transporting items from the input station to the output station(s), one or more detectors for sensing one or more respective characteristics of items transported from the input to the output stations, and a communication device coupled with the or each detector for transmitting signals related to the output of the or each detector.

A remote monitoring device includes a processor, and a communication device for receiving signals transmitted by the communication device of the item processing device, the processor being adapted to monitor the received signals and to generate an output related to the items being transported.

19 Claims, 6 Drawing Sheets

ITEM HANDLING SYSTEM

FIELD OF THE INVENTION

The invention relates to an item handling system, for example for counting or sorting documents or coins.

DESCRIPTION OF THE PRIOR ART

The invention is primarily concerned with systems for handling documents of value such as banknotes but is also applicable to other types of document such as tokens, cheques, postal orders, tickets and the like as well as coins.

Many products exist for counting and sorting documents such as the De La Rue 2800 machine. In these machines, the documents are loaded into an input station, transported past one or more detectors which sense respective characteristics of the documents and then, depending upon the outcome of the characteristics which are detected, the documents are fed to an appropriate one of the output stations. In some circumstances, the transport may be stopped on the detection of a particular type of document and where this facility is provided, it is possible to utilize a single output station. Thus, for example, in the case of banknotes, these can be sorted on the basis of denomination, series, fitness, authenticity and the like into different output stations. Alternatively, a particular type of document such as a particular denomination or series can be outsorted with all other documents being fed to a cull station or the machine may simply be stopped on detecting such a document.

One problem with these types of handling system is the need to incorporate into each system complex software and hardware to enable the characteristics to be determined. Thus, typically, the detectors will sense certain characteristics of an item such as reflectance or transmittance and these properties will then be processed by an on-board processor to determine the denomination of the item being transported. This information is then used by the on-board processor to control the further transport of the item (as described above) and also to increment appropriate counters with the value of the item so that ultimately a total value can be obtained of the batch which has been processed. A further problem exists in that to provide the required range of machine operating modes and recognition, validation and authentication processes, the facilities for the operator to switch between processes requires more memory and less user friendly operator interfaces facilities. Alternatively, it involves more regular updating of machines with new operating configurations, new recognition pattern/authentication details etc. and operators to be regularly updated with the changes to the machines operating facilities. This requires either physically changing memory chips or individually reprogramming resident memory in each machine, a time consuming operation. Additionally, features such as error reporting, machine performance logging, throughput, operator performance and auditing required by the users are contributing to the problems. Furthermore, whilst the requirements exist to make the machines more sophisticated there exists at the same time the requirements that the sizes of sorting/counting machines are maintained or made smaller.

SUMMARY OF INVENTION

In accordance with the present invention, an item handling system comprises:

a) an item processing device having input and output stations, a transport system for transporting items from the input station to the output station(s), one or more detectors for sensing one or more respective characteristics of items transported from the input to the output stations, and a communication device coupled with the or each detector for transmitting signals related to the output of the or each detector; and, b) a remote monitoring device including a processor, and a communication device for receiving signals transmitted by the communication device of the item processing device, the processor being adapted to monitor the received signals and to generate an output related to the items being transported.

We have devised a new type of item handling system in which the item processing device is significantly simplified as compared with present day devices, some or all of the signal processing being transferred to the remote monitoring device. This has a number of advantages. Firstly, the item processing devices themselves have a much simpler and cheaper construction since it is not necessary to provide a full on-board processing capability on each device. Secondly, it allows an operator to utilize the item processing device from a remote location which may often be more convenient. Thirdly, in some situations, more than one item processing device can be linked to the same remote monitoring device again leading to significant flexibility.

Likewise, more than one remote monitoring device can be linked with one processing device. In addition it provides a potentially sophisticated interface with world wide communication networks to enable it to receive suitably addressed updated information such as programme and memory content updates from anywhere in the world and to send out suitably addressed information concerning such items as sheet processing rates, serial numbers, magnetic or optical readable information, image processing, OCR information, batch auditing, machine performance, faults occurring etc. to anywhere in the world. With the allocation of each mobile to an operator, i.e. identified with an operator, the source of data downloaded to each item processing device can be identified, just as data from each item processing device is identified. A significant advantage from using the hand held portable remote monitoring device exists in the facility to connect the item processing device(s) to the network only when they are required.

The distribution of intelligence between the item processing device and the remote monitoring device can be varied in a number of ways. In the simplest approach, the signals output by the or each detector are transmitted in substantially raw form to the remote monitoring device for further processing. These signals may undergo some preprocessing within the item processing device, for example to remove noise and to convert to digital form. However, all intelligence, particularly relating to the determination of features such as authenticity, denomination and fitness are carried out by the remote monitoring device processor.

In a second approach, some analysis of the signals from the detector(s) is carried out by a processor provided in the item processing device. Thus, the item handling device processor may perform an initial analysis of the detector output and generate corresponding output signals for transmission to the remote monitoring device. This initial analysis may comprise, in the case of documents, a pattern matching or correlation algorithm in which signals representing transmittance or reflectance properties of pixels of each document define test data which is then matched with sets of prestored data representing master patterns. The outcome of this correlation process which will simply provide for each set of prestored data a measure of the similarity existing between it and the test data is then supplied to the remote monitoring device which uses the measures of similarity to classify (identify by best fit) the document. The advantage of this is that the amount of data transmitted is reduced but with the penalty that some on-board processing is required by the document processing device.

The remote monitoring device can in some cases simply receive signals from the item processing device, analyse them and provide an output which is stored or displayed. For example, in the case of banknotes, the remote monitoring device may increment a count of the total value or number of banknotes being transported. In a preferred approach, however, the remote monitoring device processor is adapted to respond to the received signals to carry out a predetermined analysis so as to determine information about each item and to provide a corresponding output control signal which is supplied to the item processing device. Thus, the remote monitoring device not only receives signals from the item processing device but in response to them sends control signals to the item processing device. These control signals may be used to activate one or more diverters within the transport system or to halt operation of the device when, for example, an unrecognisable item is being transported. They may also be used to activate an indication, for example an illumination or audible signal, to the local operator about the status of the machine.

The item processing device and remote monitoring device may be connected via a hard wired system but preferably they communicate via a wireless link such as an infrared link. In addition, or alternatively, communication between them could be achieved via one or more of the Internet, cable, satellite, or telephone networks.

The remote monitoring device may comprise a desktop computer such as a PC but conveniently comprises a handheld, portable device such as a laptop computer, palm computer, PDA, a mobile telephone with on-board processing capability which can then be carried by the operator, or Internet physical or virtual server.

As previously mentioned above, although each item handling system may comprise an item processing device and a corresponding remote monitoring device, it is also possible to provide a plurality of item processing devices and a single remote monitoring device which can communicate with each item processing device. This enables a single operator conveniently to control the plurality of item processing devices simultaneously. This will typically involve the machine being provided with a unique address contained in its memory, and the machine responding to instructions transmitted from the palm computer or other remote monitoring device so addressed. Likewise, information sent from the machine will be identified as coming from that machine. The plurality of item processing devices handled may be of different types, for example single pocket document counters and two or three pocket document sorters.

BRIEF DESCRIPTION OF THE DRAWINGS

Some examples of document handling systems will now be described with reference to the accompanying drawings, in which.

DETAILED DESCRIPTION OF EMBODIMENTS

Figure 1:
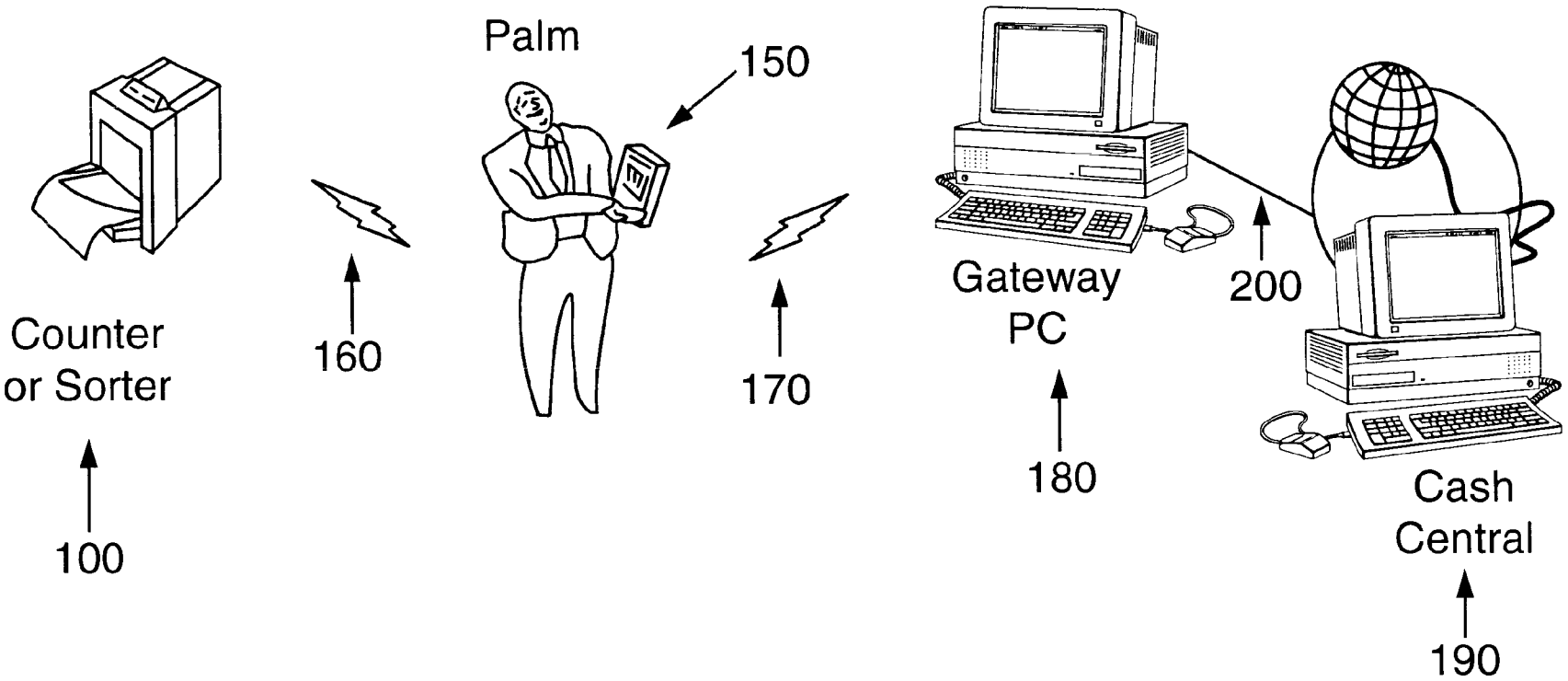
FIG. 1 is a schematic overview of the system.

As shown in FIG. 1, the overall system comprises a counter or sorter 100 which is linked with a palm computing device 150 via a communications link 160. In turn, the palm computing device 150 is coupled via a link 170 with a gateway PC 180 which in turn is linked to a central cash monitoring facility 190 via a link 200.

Figure 2:
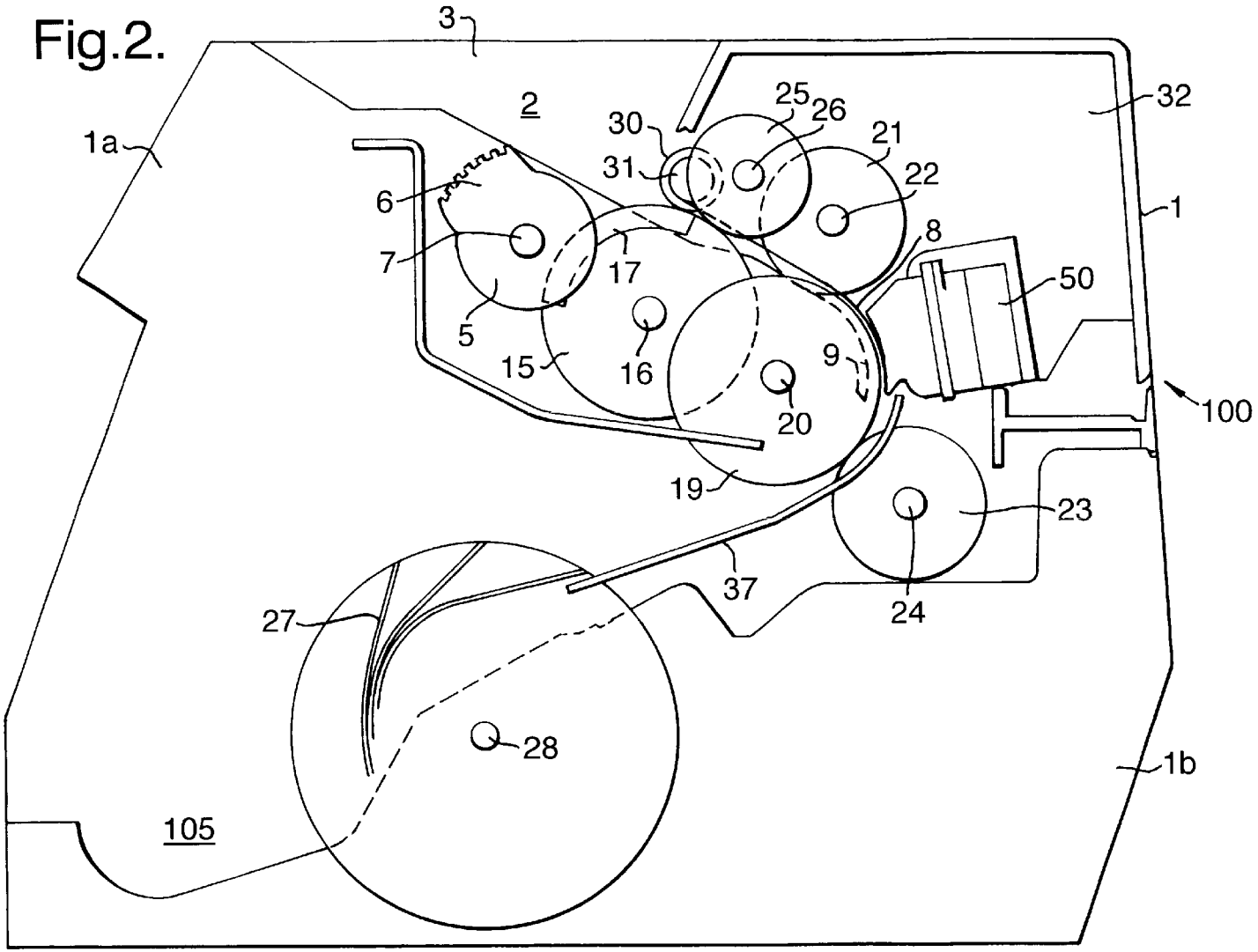
FIG. 2 is a schematic diagram showing the primary transport components of a first example of the counter/sorter shown in FIG. 1.

The counter 100 is shown in more detail in FIG. 2 and includes an input hopper 2 mounted beneath an inlet opening 3 in an enclosure 1 which comprises upper and lower parts 1*a*, 1*b* normally screwed together. Contained within the enclosure 1 is an internal chassis assembly (not shown for clarity) which itself has side members between which the sheet feeding and transport components to be described herein, are mounted. Two conventional feed wheels 5 are non-rotatably mounted on a shaft 7, which is rotatably mounted to the chassis assembly, and have radially outwardly projecting bosses 6 which, as the feed wheels rotate, periodically protrude through slots in the base of the hopper 2.

Figure 3:
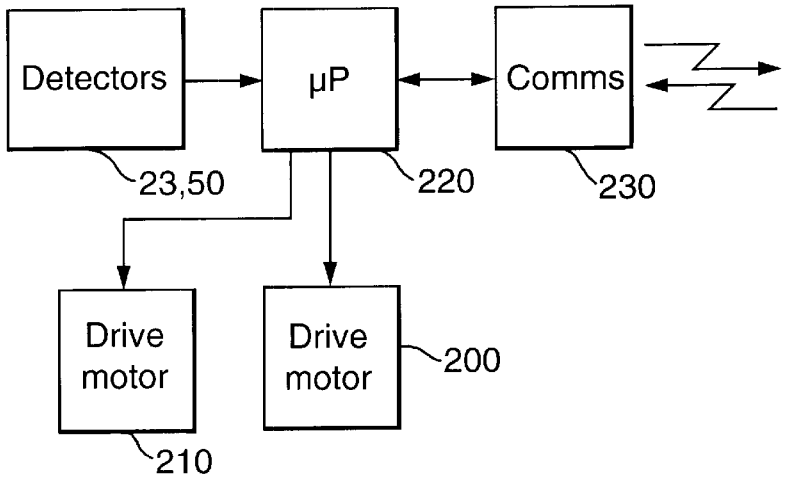
FIG. 3 is a block diagram of the non-mechanical components in the counter/sorter of FIG. 2.

A pair of stripper wheels 15 are non-rotatably mounted on a drive shaft 16 which is rotatably mounted in the chassis assembly. Each stripper wheel 15 has an insert 17 of rubber in its peripheral surface. Shaft 16 is driven clockwise by a motor 200 (FIG. 3) to feed notes individually from the bottom of a stack of notes placed in the hopper 2.

Transversely in alignment with, and driven from the circumferential peripheral surface of the stripper wheels 15, are pressure rollers 30 which are rotatably mounted on shafts 31 spring based towards the stripper wheels 15. Downstream of the wheels 15 is a pair of transport rollers 19 non-rotatably mounted on a shaft 20 rotatably mounted in the chassis assembly. Shaft 20 is driven clockwise from a second motor 210 (FIG. 3) to transport the note in the transport arrangement, in conjunction with pairs of pinch rollers 21 and double detector rollers 23, into stacking wheels 27 and hence output hopper 105. Pinch rollers 21, rotatably mounted on shafts 22 spring based towards the transport rollers 19, transversely align with rollers 19 and are driven by the peripheral surface of the rollers 19. The double detector rollers 23, rotatably mounted on shafts 24 are in alignment with the transport rollers 19, and are essentially caused to rotate by the note passing between the adjacent peripheral surfaces of the rollers 19 and 23.

Situated between the pressure rollers 30 and pinch rollers 21 are separator roller pair 25, non-rotatably mounted on shaft 26 adjustably fixed to a top moulding assembly 32, having a circumferential peripheral surface which is nominally in alignment with the peripheral circumferential surface of, but transversely separated from, the stripper wheels 15.

Also forming part of the top moulding assembly 32, is a curved guide surface 8 extending partly around the circumference of the rollers 15, 19 which, when the top moulding is lifted allows the operator access to the note feed and transport path so that a note jam can be cleared. A surface 37 provides note guiding from the end of the curved guide surface 8 to the conventional stacking wheels 27.

The drive motor 200 continuously drives the drive shaft 16, and, via a belt and pulley arrangement from shaft 16, the auxiliary drive shaft 7 rotating the feed wheel 5. Drive shaft 20, rotating the transport rollers 19, is driven by the other drive motor 210. A further pulley and belt arrangement (not shown) between shaft 20 and shaft 28, on which the stacking wheels 27 are non-rotatably mounted, provides the drive to the stacking wheels 27.

A guide plate 9 extends as a continuation of the base of the hopper 2 towards the nips formed between the transport rollers 19 and the double detector rollers 23.

A linear photodiode array 50 is mounted adjacent to the transport path. This extends across the full length of the banknotes (transverse to the feed direction), so as to detect light originating with a light source (not shown) reflected off the facing surface of banknotes as they pass beneath the detector. (Other known detectors could be used which, for example, only scan a portion or portions of the banknotes. Also, one or more detectors may be provided for determining transmittance, thickness, size etc. of the banknotes.) The array 50 is coupled with an on-board processor 220 which samples the photodiode outputs regularly.

In this example, the sampled photodiode output signals are temporarily stored by the microprocessor 220 and then fed, typically in digital form, to a communications device 230 which includes an infrared transmitter for transmitting the signals to the palm computing device 150 and an infrared receiver.

Typically, also, signals from the double detect rollers 23 will be output by the communications device 230 although in some cases the microprocessor 220 could itself respond to those signals, for example to stop one or both the drive motors 200, 210. In that event, the microprocessor 220 would issue a warning signal via the communications device 230 to the palm computing device 150 to alert the operator.

Figure 4:
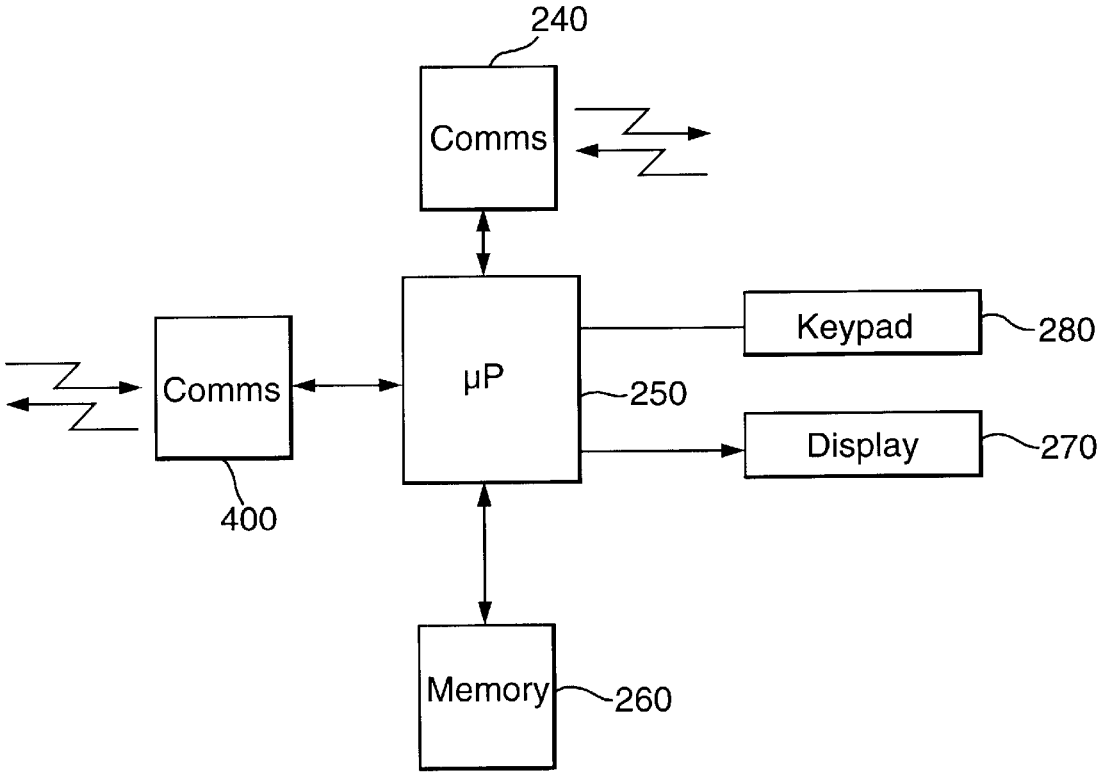
FIG. 4 is a block diagram illustrating the primary components in the palm device shown in FIG. 1.

FIG. 4 illustrates a typical construction for the palm computing device 150 which includes a communications device 240 having both an infrared transmitter and an infrared receiver. The receiver will receive signals issued by the transmitter of the device 230 and feed them to a microprocessor 250. The microprocessor 250 will then carry out a pattern matching algorithm of a conventional type utilizing prestored master pattern data in a memory 260 in order to identify the banknote currently being fed by the counter 100. This may involve a simple pixel to pixel comparison with one or more prestored patterns or a more complex system, for example based on a neural network as described in more detail in WO 00/26861.

Assuming that the microprocessor 250 can identify the denomination of the banknote being fed, it will increment a value count appropriately and typically also arrange for this incremented count to be displayed on a LCD display 270. If the microprocessor 250 is unable to recognise the denomination of the banknote then it will issue an error signal via the communication device 240 to the communication device 230 of the counter 100. The microprocessor 220 will respond to this error signal to stop at least the drive motor 200 to prevent further banknotes being fed. The microprocessor 250 will also display an error message on the display 270.

The microprocessor 250 may also determine other information about the banknotes such as authenticity and/or fitness depending upon the information which it receives from the counter 100.

The palm computing device 150 also has a key pad 280 to enable the operator to enter control commands of a conventional nature via the palm computing device to the counter 100 and/or to input the values of notes whose denomination could not be determined by the apparatus.

Figure 5:
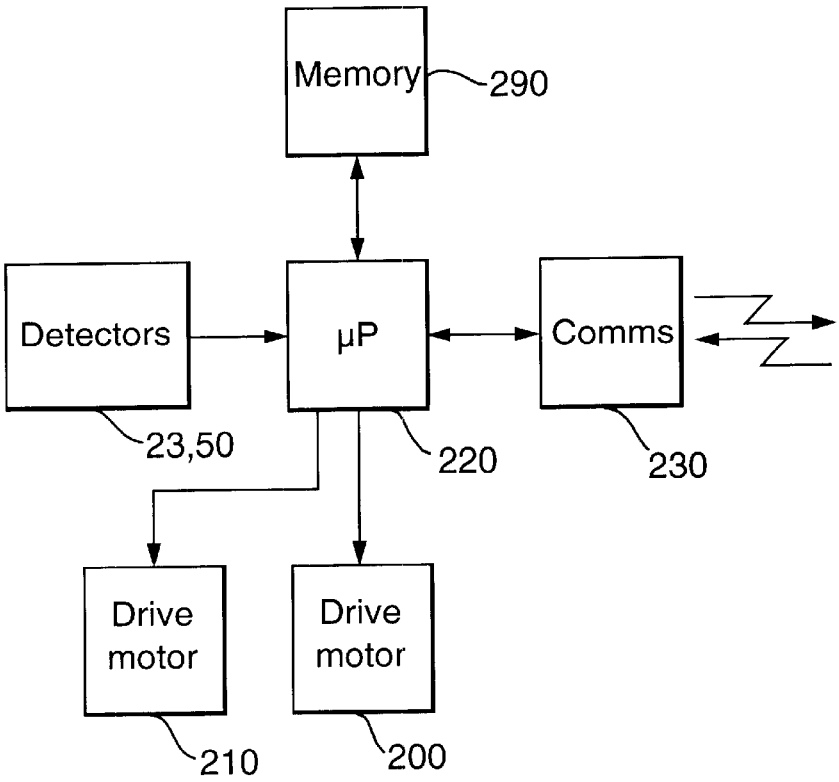
FIG. 5 is a block diagram similar to FIG. 3 but of a second example.

FIG. 5 illustrates a modified form of counter in which an additional memory 290 is provided. This is intended to store sets of data representing master patterns or other data required for pattern analysis which can be performed by the microprocessor 220. However, the microprocessor 220 will do no more than calculate a measure of similarity between the document under test and each set of data representing the master patterns and these results will be transmitted to the palm computing device 150. The microprocessor 250 will then compare each measure of similarity with each of the others to select the "best match" and then utilize a look-up table or the like to determine the denomination corresponding to the identified pattern so that it can increment a count appropriately.

Figure 7:
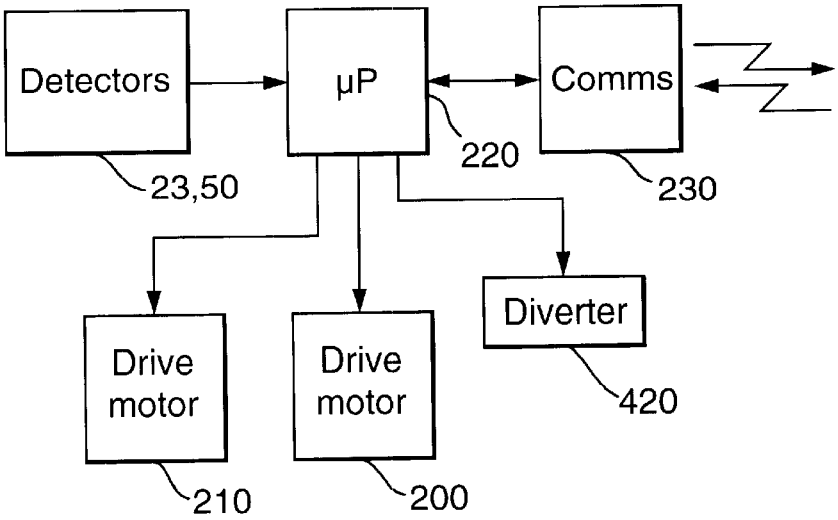
FIG. 7 is a view similar to FIG. 3 but for use with the FIG. 6 example.
Figure 6:
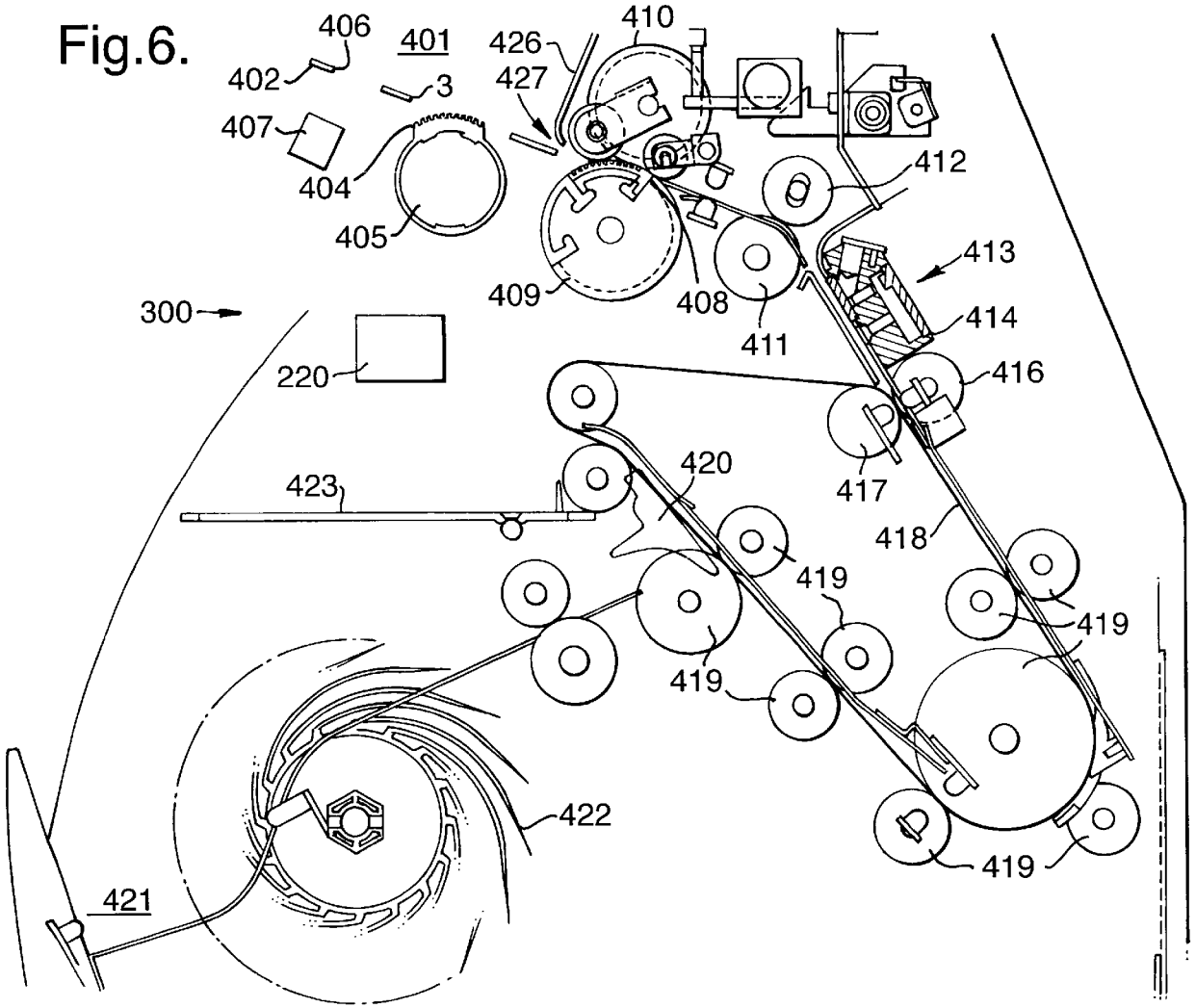
FIG. 6 is a view similar to FIG. 2 but of a second example.

The counter 100 shown in FIG. 2 has a single output hopper 105. The invention is also applicable, however, to counters/sorters having multiple output hoppers and FIG. 6 illustrates such an example with two output hoppers. The FIG. 6 counter 300 has an input hopper 401 having a base 402 with an aperture 403, through which a high friction portion 404 of a nudger wheel 405 can project. The base 402 optionally has a second aperture 406 in alignment with a barcode reader 407 for reading data on note separators. Bank notes are supported in a stack on the base 402 against a front wall 426, and are fed intermittently by rotation of the nudger roller 405 into a nip 408, between a high friction feed roller 409 and a separator, counter rotating roller 410. The nudger 405 and roller 409 are driven by a motor 200 (not shown). The documents pass through pinch rollers 411, 412 into a pattern detection region 413 in which a sensor 414 scans the bank note as it is fed and passes information back to a microprocessor 220 (FIG. 7). Each bank note is then fed through pinch rollers 416, 417 onto a drive belt 418 which conveys the bank note around various rollers 419 to a diverter 420. At least one of the rollers is driven by a motor 210 (not shown). The position of the diverter 420 is controlled by the microprocessor 220, so that bank notes are guided either towards an output pocket 421, where they are stacked using a rotating stacking wheel 422 in a conventional manner, or to a reject bin 423.

As can be seen, the bank notes are stacked on the base 402 and are urged forward against the front wall 426. A small gap 427 is provided at the base of the front wall, through which individual bank notes and separators can be nudged.

As can be seen in FIG. 7, the counter operating components are modified to include the ability for the microprocessor 220 to control the diverter 420. Consequently, when the palm computing device 150 receives signals from the counting device which it determines indicate that a banknote denomination cannot be ascertained, it sends the appropriate error signal back to the counting device and the microprocessor 220 responds by actuating the diverter 420 so that the banknote is diverted into the cull pocket 423. Of course, there may be other reasons for diverting banknotes as in conventional sorters.

Figure 8:
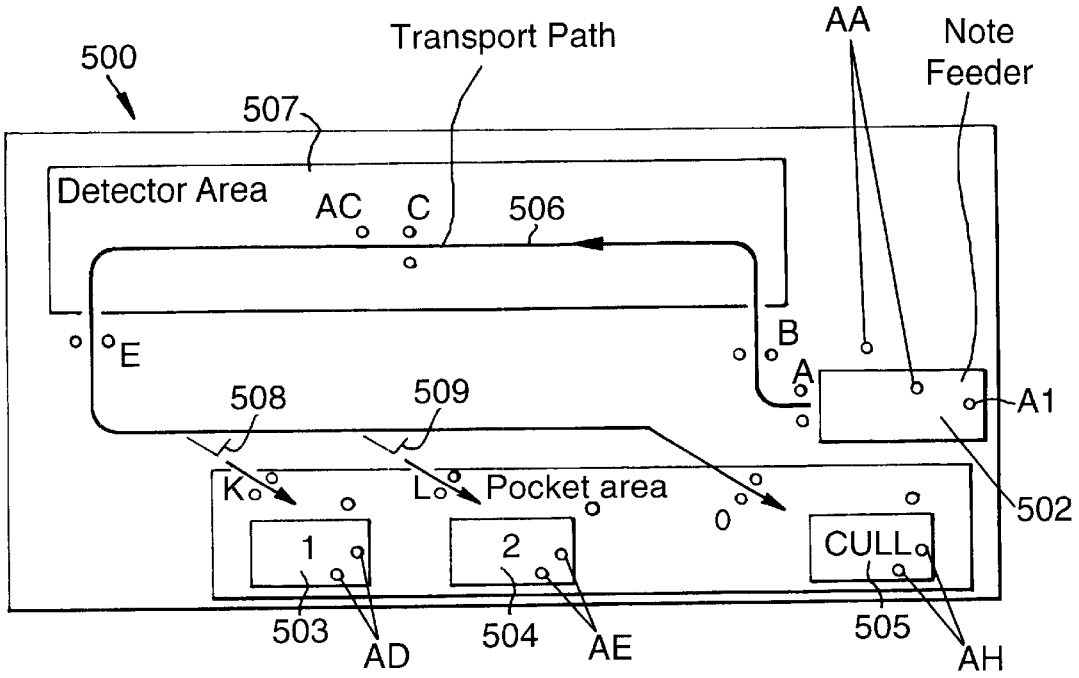
FIG. 8 illustrates a further example of a sorter.

FIG. 8 illustrates schematically a further counter 500 based generally on the De La Rue 3700 sorter. This comprises an input hopper 502 into which a stack of notes is placed, a pair of output pockets 503, 504 into which banknotes are sorted and a cull pocket 505. As with the previous examples, this sorter 500 will interface with a palm computing device 150 (not shown) for the purposes of control of the manner in which banknotes are sorted into the pockets 503, 504 and 505.

Banknotes are fed from the input hopper 502 along a transport path 506 through a detector area 507 which obtains image information from the banknotes. This image information is temporarily stored and then transmitted to the palm computer 150 for analysis. The palm computer then issues a control signal to the microprocessor (not shown) of the sorter so as to control one of the diverters 508, 509 to feed the banknote into an appropriate one of the pockets 503, 504 respectively or to allow the banknotes to be transported to the cull pocket 505.

The communication link 160 is described above as an infrared link. However, other forms of link could also be used including a hard wired link, or links via the Internet, cable, satellite or telephone network. Of course, where the palm computing device 150 issues control signals, these links must enable data to be communicated sufficiently quickly to be processed and for a control signal to be issued before the current banknote has reached the transport point at which the controlled action has to be effected or it has been transported to the output hopper.

The palm computing device 150 may operate in a stand alone manner with the counter/sorter 100, 300. As mentioned above, it will typically include a stored pattern set and will also include other configuration and accounting software.

Conveniently, however, the palm computing device 150 can communicate via a communications device 400 with the gateway PC 180. Again, this is via the link 170 which may be of any of the types already mentioned above. The gateway PC 180 enables updated pattern set data to be transmitted to the palm computing device and also can receive audit information and the like from the device 150.

Finally, information from the gateway PC 180 can be uploaded to a central cash location via the link 200 which again may be of any of the types mentioned above to enable various cash management and other auditing processes to be undertaken.

One particular advantage of linking the palm computing device 150 with gateway PC 180 is that where there are a number of such palm computing devices, the gateway PC 180 can supply master pattern data and the like to all the palm computing devices relatively automatically.

We claim:

1. An item handling system comprising:

a) an item processing device having input and output stations, a transport system for transporting items from the input station to the output station(s), one or more detectors for sensing one or more respective characteristics of items transported from the input to the output stations, and a communication device coupled with the one or more detectors for transmitting signals related to the output controlling said processing device of; and, b) a remote monitoring device including a processor, and a communication device for receiving signals transmitted by the communication device of the item processing device, the processor being adapted to monitor the received signals and to generate an output related to the items being transported.

2. A system according to claim 1, wherein the processor is adapted to respond to the received signals to carry out a predetermined analysis so as to determine information about each item and to provide a corresponding output control signal which is supplied to the item processing device.

3. A system according to claim 2, wherein the item processing system has more than one output station, and wherein the transport system includes at least one diverter which is controlled by the control signal from the remote monitoring device to divert items to an appropriate one of the output stations.

4. A system according to claim 1, the item processing device having a single output station.

5. A system according to claim 2, wherein the transport system is adapted to stop in response to the receipt of certain output control signals from the remote monitoring device.

6. A system according to claim 1, wherein the one or more items characteristic is chosen from the group comprising reflectance, transmittance, thickness, size, and magnetic properties.

7. A system according to claim 1, wherein the items comprise documents.

8. A system according to claim 1, wherein the monitoring device processor is adapted to determine one or more of the authenticity, denomination, and fitness of items fed by the document processing device.

9. A system according to claim 8, wherein the items comprise documents, the monitoring device processor being adapted to determine the denomination of the documents by implementing a pattern matching algorithm.

10. A system according to claim 1, wherein the item handling device includes a processor for performing an initial analysis of the detector output and for generating corresponding output signals for transmission to the remote monitoring device.

11. A system according to claim 10, wherein the item handling device processor performs a pattern matching algorithm.

12. A system according to claim 11, wherein the monitoring device processor is adapted to identify an item by reference to the pattern found to match the item by the document handling device processor.

13. A system according to claim 1, wherein the monitoring device processor is adapted to determine a total number and/or total value of the items transported.

14. A system according to claim 1, wherein the remote monitoring device is a handheld, portable device.

15. A system according to claim 1, wherein the communication devices communicate via a wireless link such as an infrared link.

16. A system according to claim 1, wherein the communication devices communicate via one or more of the Internet, cable, satellite, or telephone networks.

17. A system according to claim 1, further comprising a central processing system remote from the monitoring device and adapted to communicate with the monitoring device so as to download data for use by the processor and to receive information relating to the performance of the processor.

18. A system according to claim 1, the system comprising a plurality of item processing devices and a single remote monitoring device which can communicate with each item processing device.

19. A system according to claim 1, the system comprising a plurality of item processing devices and a plurality of remote monitoring devices which can communicate with each item processing device.

* * * * *

UNITED STATES PATENT AND TRADEMARK OFFICE

CERTIFICATE OF CORRECTION

PATENT NO. : 6,418,358 B1
APPLICATION NO. : 09/672032
DATED : July 9, 2002
INVENTOR(S) : Pietro Armanini It is certified that error appears in the above-identified patent and that said Letters Patent is hereby corrected as shown below:

Claim 1, col. 7, line 53, should read: -- the output of the one or more detectors; and --.

Claim 1, col. 7, line 58, after "output" the words -- controlling said processing device -- should be inserted.

Signed and Sealed this
Fifth Day of April, 2011

David J. Kappos

David J. Kappos
*Director of the United States Patent and Trademark Office*